US005371957A

United States Patent [19]

Gaudio

[11] Patent Number: 5,371,957

[45] Date of Patent: Dec. 13, 1994

[54] ATHLETIC SHOE

[75] Inventor: Paul A. Gaudio, Portland, Oreg.

[73] Assignee: Adidas America, Inc., Portland, Oreg.

[21] Appl. No.: 167,570

[22] Filed: Dec. 14, 1993

[51] Int. Cl.[5] ..... A43B 11/00

[52] U.S. Cl. ..... 36/50.1; 36/45

[58] Field of Search ..... 36/89, 92, 107, 45, 36/50.1, 52, 53, 91, 11.5

[56] References Cited

U.S. PATENT DOCUMENTS

| | | | |
|---|---|---|---|
| 838,751 | 12/1906 | Roberts | 36/50.1 X |
| 892,152 | 6/1908 | Harman | 36/89 X |
| 1,419,676 | 6/1922 | Koch | 36/11.5 X |
| 1,831,396 | 11/1931 | Rosenthal | 36/3 A |
| 2,083,390 | 6/1937 | Murena | 36/45 |
| 2,169,337 | 8/1939 | Davis | 36/11.5 |
| 2,513,005 | 6/1950 | Crawford | 36/11.5 |
| 2,696,057 | 12/1954 | Flautt | 36/11.5 |
| 2,740,207 | 4/1956 | Starensier | 36/11.5 X |
| 2,758,395 | 8/1956 | Miyaji | 36/11.5 |
| 2,936,533 | 5/1960 | Paynor | 36/11.5 X |
| 2,994,972 | 8/1961 | Blair | 36/92 |
| 3,553,754 | 1/1971 | Mendelsohn | 36/11.5 X |
| 3,928,927 | 12/1975 | Brown et al. | 36/11.5 |
| 4,255,876 | 3/1981 | Johnson . | |
| 4,294,023 | 10/1981 | Banfold | 36/50.1 X |
| 4,644,669 | 2/1987 | Greco | 36/11.5 X |
| 4,756,098 | 7/1988 | Boggia . | |
| 4,766,681 | 8/1988 | O'Rourke et al. | 36/50.1 X |
| 4,769,927 | 9/1988 | Liggett et al. . | |
| 4,800,657 | 1/1989 | Brown | 36/91 X |
| 4,942,678 | 7/1990 | Gumbert . | |
| 5,184,378 | 2/1993 | Batra | 36/50.1 X |
| 5,291,671 | 3/1994 | Caberlotto et al. | 36/92 X |

FOREIGN PATENT DOCUMENTS

| | | | |
|---|---|---|---|
| 1090326 | 5/1955 | France | 36/89 |
| 3813470 | 11/1989 | Germany | 36/50.1 |
| 0021146 | of 1906 | United Kingdom | 36/50.1 |

*Primary Examiner*—Paul T. Sewell
*Assistant Examiner*—Ted Kavanaugh
*Attorney, Agent, or Firm*—Klarquist Sparkman Campbell Leigh & Whinston

[57] ABSTRACT

An athletic shoe with a shoe upper having a plurality of panels, each of which is secured at a lower edge to the sole of the shoe, and has an arc-shaped upper edge including a high strength flexible loop of cable secured at each of its ends to the sole of the shoe. Each cable is hemmed into the periphery of a panel, and may be exposed in places along the upper edge of the panel so that shoelaces may be looped around the cable to draw together the cables on the medial and lateral sides of the shoe, securing the sole to the wearer's foot.

28 Claims, 3 Drawing Sheets

ATHLETIC SHOE

TECHNICAL FIELD

This invention relates to footwear, and more particularly to athletic shoes.

BACKGROUND AND SUMMARY OF THE INVENTION

Support, flexibility and light weight are three important considerations in the design of athletic shoes.

First, support provides that the sole of a shoe be securely attached to the wearer's foot, without significant displacement of the sole relative to the foot, even under substantial force. Support strength is compromised when a shoe's structural materials or closure apparatus stretches under significant loads, or stretches or weakens over time, resulting in an undesirably loose fit. Strength also generally provides durability of support over long-term use.

Second, flexibility in a shoe is desirable because it provides comfort to the wearer and is generally believed to provide better athletic performance, fewer injuries, and better overall health. Ideally, a shoe would be sufficiently flexible so as not to significantly restrict natural foot movements.

Third, it is also desirable to minimize the weight of a shoe for several reasons. Athletic performance is improved by reducing the amount of energy that goes into carrying the shoe's weight, and manipulating it during athletic activities. Also, a lighter shoe generally correlates with reduced material costs and lower shipping costs.

Conventional shoe designs must weigh a trade-off between the benefits of improved support, against the accompanying disadvantages of reduced flexibility and increased weight in a strengthened shoe. Conversely, conventional shoes have been designed for very light weight and great flexibility, but with a sacrifice in support, making them unsuitable for long-term vigorous athletic activities that create substantial shoe forces. In addition, such low strength shoes tend to wear out prematurely or fail during use.

Current shoe designs generally have "uppers" constructed as substantially unbroken expanses of leather, synthetic fabric, or the like. These solid sheets of material are generally flexible as two dimensional sheets. However, when sewn in a three dimensional form, they become more resistant to flexing. Because the solid panels of material carry loads distributed across their entire areas, they must remain largely unbroken to preserve strength. Such solid panels have limited flexibility. Ventilation is limited to the permeability of the material or to a minimal amount of perforation.

From the foregoing, it will be recognized that there is a need for an athletic shoe that overcomes these drawbacks of the prior art by providing a structure that is sufficiently strong to durably bear substantial loads and resist stretching, while providing a light weight shoe that is flexible for comfort and performance, and which provides for adequate foot ventilation. The present invention satisfies this need.

By providing a shoe upper having a plurality of panels, each of which is secured at a lower edge to the sole of the shoe, and has an arc-shaped upper edge including a high strength flexible loop of cable secured at each of its ends to the sole of the shoe underneath the wearer's foot. Because the cable bears the majority of the load, each panel may be perforated with large openings for ventilation, to facilitate flexibility, and to provide an aesthetic appearance, without impairing strength. The cable may be exposed in places along the upper edge of the panel so that shoelaces may be looped around the cable to draw together the cables on the medial and lateral sides of the shoe, securing the sole to the wearer's foot.

The foregoing and additional features and advantages of the present invention will be more readily apparent from the following detailed description which proceeds with reference to the accompanying drawings.

DETAILED DESCRIPTION OF A PREFERRED EMBODIMENT

Figure 1:
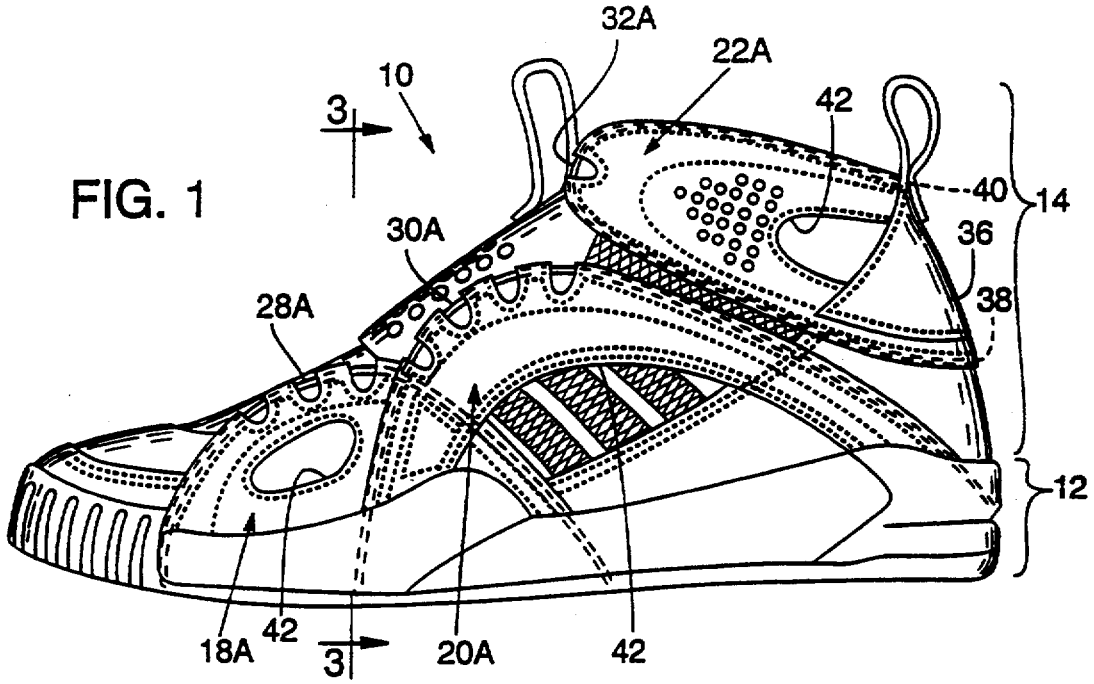
FIG. 1 is a lateral side view of an athletic shoe according to the present invention.
Figure 2:
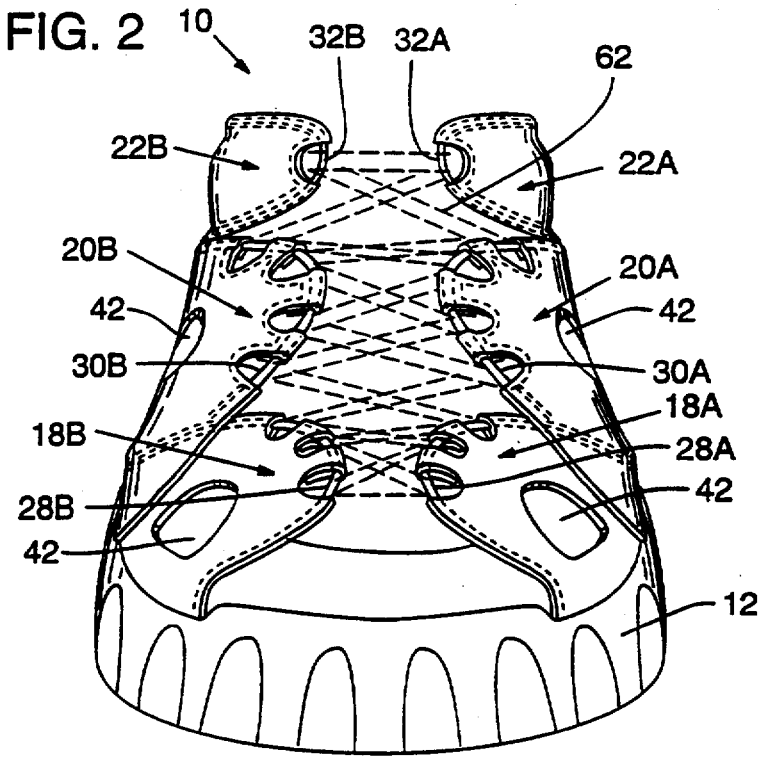
FIG. 2 is a front view of the embodiment of FIG. 1.

FIG. 1 illustrates an athletic shoe 10 having a footbed or sole 12 attached to an upper 14. The upper includes six flexible panels: a lateral forefoot panel 18A, a lateral midfoot panel 20A and a lateral collar panel 22A. As shown in FIG. 2, the upper includes corresponding medial forefoot, midfoot and collar panels 18B, 20B and 22B. The panels 18A, 20A, 22A, 18B, 20B and 22B each include a corresponding cable 28A, 30A, 32A, 28B, 30B and 32B. Each cable is attached to the upper or forward periphery of the corresponding panel for reinforcement. The forefoot and midfoot panels 18A, 18B, 20A, 20B are secured to the footbed 12 at their lower edges, with their upper peripheral edges each including a cable forming an arc rising above the footbed. The cable ends are secured to the footbed as will be discussed in detail below, so that upward tension on the cables transmits force directly to the footbed. The number, size, shape, and positions of the cables and panels may widely vary depending on the sport for which the shoe is designed.

The collar cables 32A and 32B are not attached to a footbed, but extend forwardly from the heel counter 36, which is positioned to rearwardly support the wearer's heel and ankle. The collar cables 32A and 32B are preferably in the form of a single cable having ends 38 that are attached to each other. Alternatively, the ends may overlap and be secured to the surrounding material at a point on the heel counter behind the wearer's heel. The collar cable 32A and 32B is continuous and unbroken where it passes behind the wearer's achilles tendon at an upper midline point 40 at the rear of the shoe. Alternatively, the collar cable may be formed as an unbroken circle, or as two separate segments that are attached to provide the illustrated configuration.

In the illustrated embodiment, each panel defines a substantial panel aperture 42. These provide ventilation, increase panel flexibility, and reduce weight.

Figure 3:
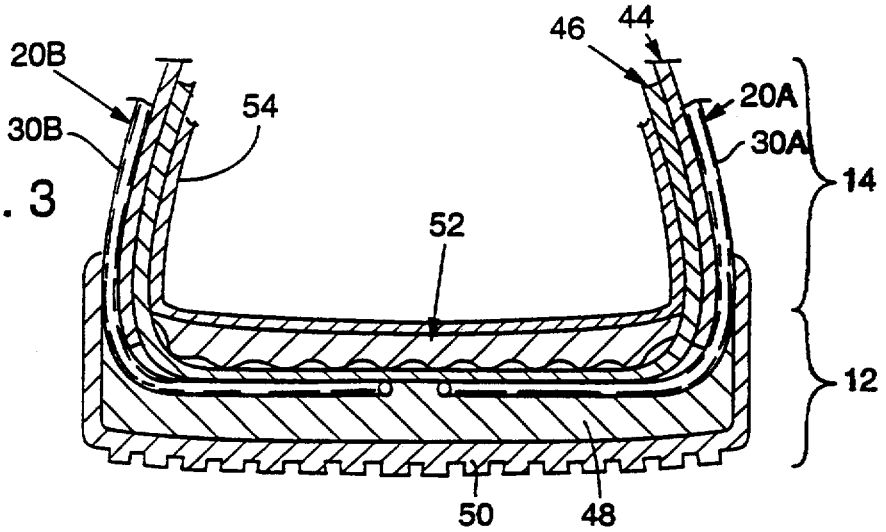
FIG. 3 is a cross sectional view taken above line 3—3 of FIG. 1.

FIG. 3 illustrates how the cables are secured to the footbed of the shoe at one location typical of all such locations. The upper 14 is made up of several layers. The illustrated lateral midfoot panel 20A includes an exterior layer 44 and a generally coextensive interior layer 46. The exterior layer is made of a durable material such as leather, while the interior layer is a soft fabric to provide comfort and avoid friction. As shown, the cable 30A is attached outside of the exterior layer 44, although the cable may also be covered by a portion of the exterior layer over much of its length, as shown in FIG. 1. The interior layer 46 extends downward, across the width of the shoe and upward on the opposite side of the shoe as a part of the medial midfoot panel 20B. The interior layer generally includes several pieces stitched together to provide the illustrated shape. The cable 30A extends downwardly beneath the interior layers 44 so that the cable is not readily detectable to the wearer.

The footbed 12 includes a cushioning foam midsole 48 that encapsulates the cable ends and adheres to the inner layer 46. A rugged outsole 50 encompasses the midsole 48 and is adhered to the exterior layers 46, and to portions of the cables. The illustrated shoe may contain an insole 52 of lightweight cushioning material to rest on the inner layer 46. The insole 52 may include an integral sock 54 extending upwardly from the perimeter edges of the insole. In a preferred embodiment, the sock and insole are removable and replaceable. This allows the use of different colors of socks to be evident through the panel apertures 42.

Figure 4A:
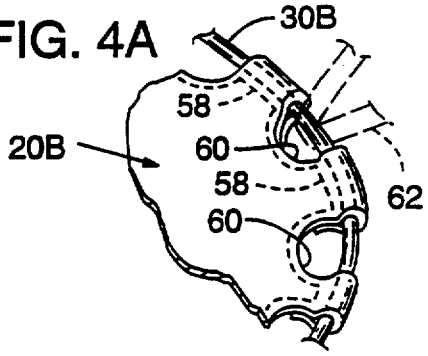
FIG. 4A is an enlarged fragmentary view of the upper perimeter of a panel of the embodiment of FIG. 1.

FIG. 4A shows a section of the perimeter of panel 20B, which is typical of the other panels. The periphery of the panel is folded over upon itself to define a passage to capture the cable 30B, and is stitched at line 58 to hem the cable within the edge of the panel. Alternatively, welding or adhesive may be used to secure the panel to itself, or to the cable. The panel defines a series of spaced apart semicircular eyelets 60 that each expose a segment of the cable. A shoelace 62 may be looped around the cable to pass through the eyelet and draw the panel towards its opposite counterpart. In the illustrated embodiment of FIG. 4A, the shoelace is looped only about the cable, and encompasses no other portion of the panel, facilitating fast lacing and adjustment. The shoelace may comprise any securement device, including Velcro® fasteners, latches, adjustable cable systems, or other adjustable fasteners.

Figure 4B:
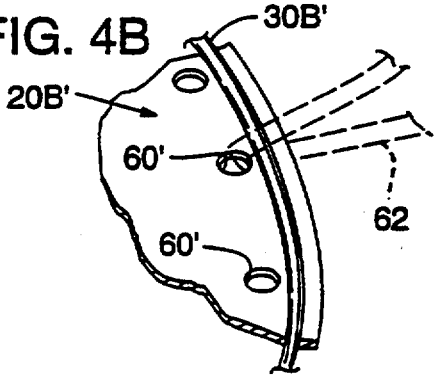
FIG. 4B is an enlarged fragmentary view of the upper perimeter of a panel of an alternative embodiment of the invention.

In the alternative embodiment shown in FIG. 4B, the cable 30B is adhered to a panel 20B' having circular eyelets 60' defined therein at spaced apart positions adjacent to the cable in the portion of the panel encompassed by the cable. In this case, laces passing through the eyelets would encompass a small portion of the panel material in addition to the cable, although the cable provides the primary means for transmitting tension to the footbed.

Figure 4C:
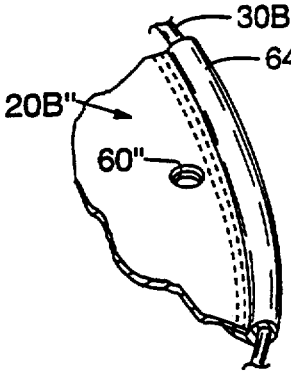
FIG. 4C is an enlarged fragmentary view of the upper perimeter of a further alternative embodiment of the invention.

FIG. 4C shows a further alternative, with a cable 30B'' entirely hidden within a peripheral seam or piping 64'' of a panel, with circular eyelets 60'' perforated nearby within the expanse defined by the cable.

Figure 4D:
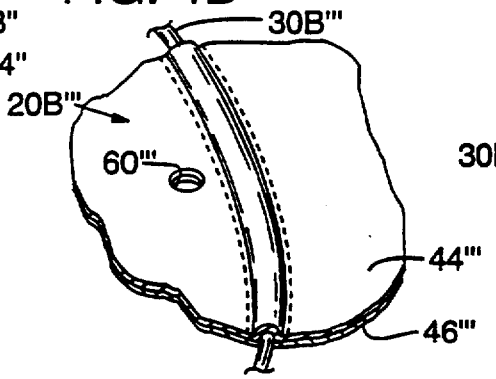
FIG. 4D is an enlarged fragmentary view of the upper perimeter of a further alternative embodiment of the invention.

FIG. 4D shows yet a further embodiment, in which cable 30''' is sandwiched within panel 20B''' between the inner layer 46''' and the outer layer 44'''. The panel extends in both directions from the cable, which is secured to an intermediate position, not the periphery of the panel. A line of stitching through the panel adjacent each side of the cable secures the cable in position. The outer panel is welted to accommodate the cable, while the inner panel remains flat to avoid creating a pressure point on the wearer's foot.

In embodiments in which the lace does not directly contact the cable, but contacts a sheathing, cover, or some adjacent material, the adjacent material is generally compressed between the lace and the cable under any appreciable force. Consequently, the adjacent material is not required to have significant tensile strength. The adjacent material may simply be a low-strength material used only for aesthetic purposes.

FIG. 2 further illustrates a lacing pattern in which the single shoelace 62 passes through each of the eyelets 60 to accommodate variations in foot size, the laces may be adjusted to draw the panels 18A, 20A, 22A 18B, 20B and 22B toward each other to the desired fit and snugness. The cables do not stretch appreciably under normal tensions, and are essentially fixed in length. All size adjustment is provided through adjusting the laces. At each point where a lace loops about a cable, the lace generates a net force that is approximately perpendicular to the cable, in the manner of vertical cables suspended from the center horizontal portion of the main catenary cable in a suspension bridge. That is, the net force direction may depart from the perpendicular to the cable by moderate amounts, but it is preferable that the net force angle remain within plus or minus 45° from the perpendicular. Departure beyond this amount causes the panel material to bear substantial forces parallel to the cable. Because the eyelets 60 are confined to a central portion of each cable farthest removed from the sole (or farthest removed from the heel counter 36 in the case of the collar cables 32A and 32B), a majority of lace tension force components are perpendicular to, and therefore carried by the cables.

Figure 5:
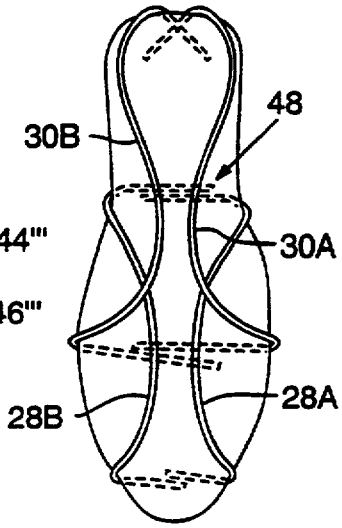
FIG. 5 is a schematic top view of the embodiment of FIG. 1 with only the sole and selected reinforcing cables visible.

FIG. 5 shows schematically how the forefoot and midfoot cables 28A, 30A, 28B and 30B are attached to the midsole 48. The forefoot cables 28A and 28B enter the midsole near the toe of the shoe, and at a position offset between one and three inches rearwardly from the toe, depending on the shoe size. Thus, the forefoot cables provide support adjacent the wearer's toes. The rear ends of the forefoot cables 28A and 28B attach to the midsole 48 at a narrow region of the midsole corresponding the arch of the wearer's foot. Thus, the medial forefoot cable 28B enhances arch support and the lateral forefoot cable 28A provides balanced opposing support. The midfoot cables 30A and 30B attach to the midsole at its widest point corresponding to the ball of the wearer's foot, and attach at their opposite ends to the heel of the midsole, providing added heel stabilization.

Figure 6:
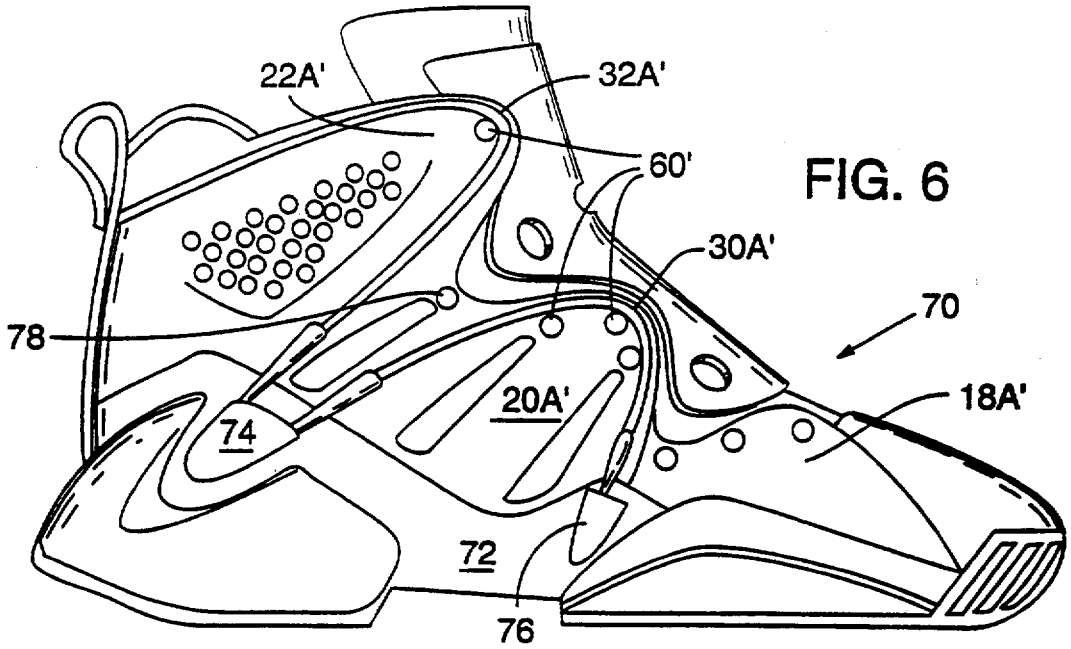
FIG. 6 is a lateral side view of an alternative embodiment of the invention.
Figure 7:
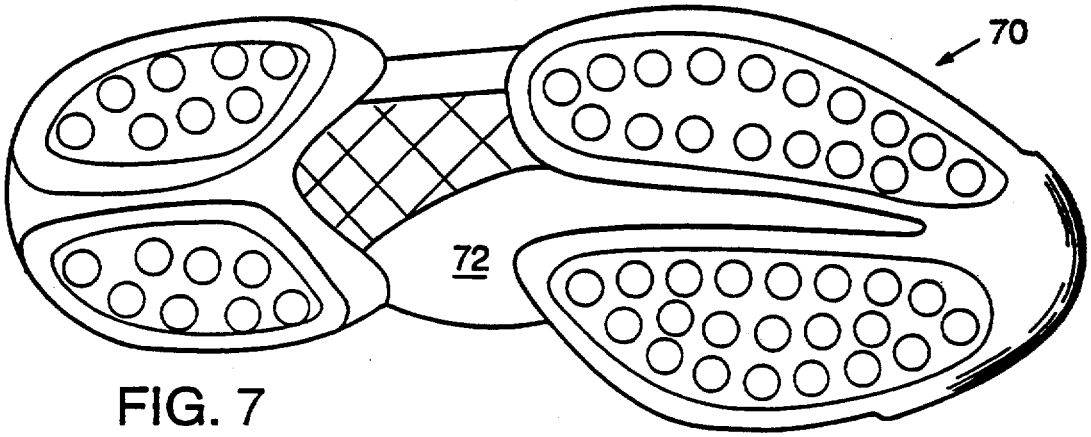
FIG. 7 is a bottom view of the embodiment of FIG. 6.
Figure 8:
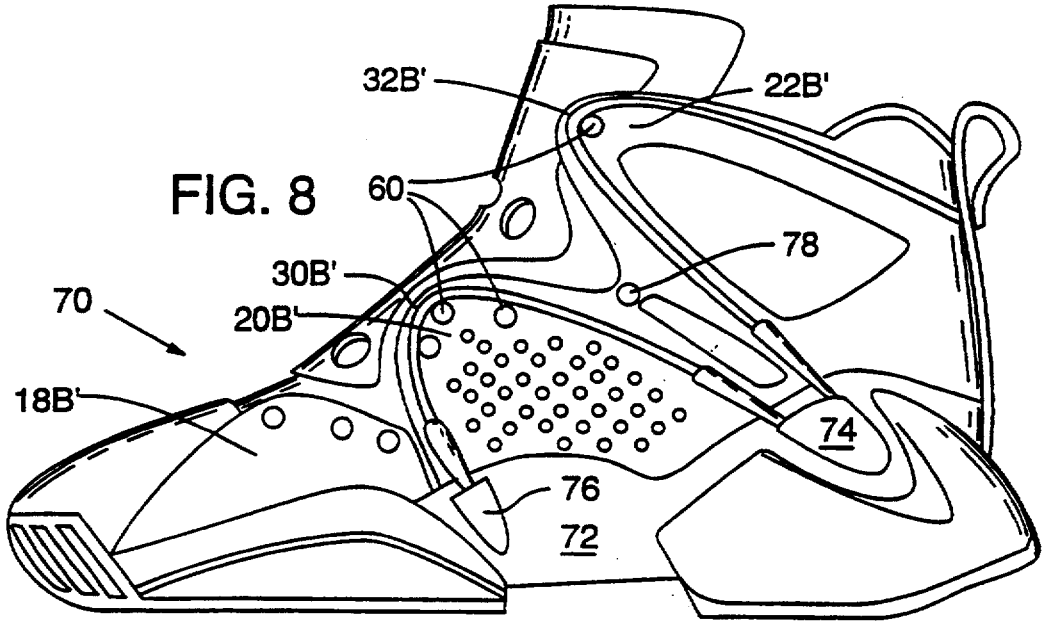
FIG. 8 is a medial side view of the embodiment of FIG. 6.

FIGS. 6, 7 and 8 illustrate an alternative shoe 70 having reinforcing cable employed in a design somewhat different from that of the embodiment of FIG. 1. As shown in FIG. 6, the shoe 70 includes a substantially rigid or resilient footbed or shank 72 that extends from the heel to the middle portion of the foot, but not past the ball of the foot. The footbed is preferably formed of a resilient thermoplastic such as P-Bax. Each side the footbed 72 includes a heel boss 74 and a midfoot boss 76. The bosses are molded integrally with the footbed, with the heel bosses 74 positioned on opposite sides of the wearer's heel, just forward of the rear of the shoe, and just above the sole. The midfoot bosses 76 are positioned just forward of the midline of the shoe, but to the rear of the ball of the wearer's foot.

The FIG. 6 shoe 70 includes forefoot panels 18A' and 18B', midfoot panels 20A' and 20B', and collar panels 22A' and 22B'. These panels are analogous to those of the embodiment shown in FIG. 1. The collar and midfoot panels include reinforcing cables 30A', 32A', 30B' and 32B' to provide strength. The ends of the cables do not extend below the footbed as in the embodiment of FIG. 1, but are secured to the bosses on the sides of the rigid footbed 72. This effectively provides the same function of transmitting tension forces from the laces or other securement device across the top of the foot, downward to the footbed or sole of the shoe. The cables may be secured to the bosses by integral molding, by a mechanical fastener such as a snap connector, or by looping about the bosses. The collar cables 32A' and 32B' connect to the heel boss 74 at their lower ends, and connect to each other behind the wearer's ankle to reinforce the collar without connection to the footbed. As in the embodiment in FIG. 1, the collar cable may comprise a single cable.

Each of the cable-reinforced panels is provided with at least one eyelet 60' near the cable and within the area bounded by the cable. In this embodiment, the eyelets are configured in the manner shown in FIG. 4B. Not all eyelets are encompassed by cable reinforced panels. Eyelet 78 is positioned between cables 30A' and 32A', with forces being transmitted through adjacent materials to the cables. The forefoot panels 18A' and 18B' each includes several eyelets, although the panels are unreinforced.

In the embodiment of FIGS. 6, 7 and 8, the cables are not sewn into a hem at the edge of the panels, but are adhered to the surface of the panels. Much of the forces transmitted to the eyelets 60' act directly on the cables. Only a small portion of the force need be transmitted between the cable and the underlying panel. Therefore, the junction between the cable and panel is not structurally critical. Although not preferable, it is possible for the cable and panel to be entirely independent, each transmitting a portion of the forces to the footbed to provide the benefits of the invention.

In the preferred embodiment of the invention, the cables are formed of thermoplastic material such as nylon. Monofilament cables may be used, although multi-filament cables such as used in tennis rackets, and plastic sheather metal cables are also contemplated. The thermoplastic material permits compatibility with the process of molding the cable into the sole of the shoe at the elevated temperatures normally associated with this process. The cable must be sufficiently flexible to permit the panels to conform to the shape of different wearer's feet and to permit easy entry and egress. However, it is preferable that the cable be sufficiently stiff or resilient so that it may support the perpendicular lacing farces without significant local deflection at the eyelets. In the preferred embodiment, the cable is sufficiently stiff that it will retain a given shape if not stressed, unlike a flaccid string or shoelace. Nonetheless, many advantages of the invention may be achieved by substituting an entirely flexible string or cable for the stiff but flexible cable of the preferred embodiment. This might be achieved by stitching a heavy, high strength cord along the edge of the panel. Furthermore, the cable need not have the round cross section illustrated. It may take the form of a band having an oblong cross-section, or may have a cross-section that varies over its length depending on the strength requirements of each portion of the cable. The cable need not be of a different material than the panel sheets; the cable and panel may be formed integrally from the same material, with the cable formed as a molded reinforcing bead at the edge of the panel. However, given the strength and flexibility properties of most materials, the preferred embodiment uses a stronger and stiffer material for the cable than for the remainder of the panel.

Having illustrated and described the principles of the invention by what is presently a preferred embodiment, it should be apparent to those skilled in the art that the illustrated embodiment may be modified without departing from such principles. The invention as claimed includes not only the illustrated embodiments, but all such modifications, variations and equivalents thereof as come within the true spirit and scope of the following claims.

I claim:

1. A shoe comprising:

a footbed;

an arcuate cable having spaced apart first and second portions, the first portion connected to the footbed at a first position on the footbed, the second portion connected to the footbed at a second position on the footbed spaced apart from the first position;

a flexible panel attached to the footbed, the cable being connected to the panel to define an encompassed panel portion bounded by the cable and the footbed such that portions of the cable are exposed between the first and second portions, the encompassed panel portion defining at least one eyelet proximate the exposed portions of the cable;

a shoelace located through the eyelet and looped about the exposed portions of the cable, with tension in the shoelace being transmittable to the cable, and thereby to the footbed.

2. The shoe of claim 1 wherein the cable is attached near the periphery of the panel.

3. The shoe of claim 1 wherein the periphery of the panel is hemmed to form a passage for receiving at least a portion of the cable.

4. The shoe of claim 3 wherein the edge of the panel is folded over and sewn to define the passage.

5. The shoe of claim 1 including a second, similar cable reinforced panel attached to the footbed apart from the first cable and panel, with the shoelace adjustably connecting the panels.

6. The shoe of claim 1 wherein the encompassed panel portion defines an aperture larger than the eyelet, and wherein the shoe includes a removable sock including a molded insole, such that the sock is visible through the aperture when installed in the shoe.

7. The shoe of claim 1 wherein the first position on the footbed is near a toe of the shoe and the second position on the footbed is near the midpoint of the length of the shoe.

8. The shoe of claim 1 wherein the first position on the footbed is near the ball of the shoe and the second position of the footbed is near a heel of the shoe.

9. The shoe of claim 1 including more than one cable reinforced panel on each side of the shoe.

10. The shoe of claim 1 wherein the cable is a thermoplastic material.

11. The shoe of claim 1 wherein the cable has a circular cross-section.

12. The shoe of claim 1 wherein the cable material is nylon.

13. The shoe of claim 1 wherein the footbed includes a rigid portion connected to the cable.

14. An athletic shoe, comprising:

a sole having a toe portion proximate a forward end of the sole and a heel portion proximate a rearward end of the sole;

a first cable-panel having a substantially inelastic cable and a flexible panel connected to the cable wherein the cable is fixedly attached to the sole at first and second sole locations, the first sole location being disposed between the second sole location and the forward end; and a second cable-panel having a substantially inelastic cable and a flexible panel connected to the cable wherein the cable is fixedly attached to the sole at third and fourth sole locations, the third sole location being disposed between the first and second sole locations and the fourth sole location being disposed proximate to the rearward end such that the first and second cable-panels overlap between the second and third sole locations.

15. The athletic shoe of claim 14 further comprising a heel counter fixedly connected to the sole at the heel portion, and a collar cable-panel having a substantially inelastic cable and a flexible panel fixedly connected to the cable, the collar cable-panel being fixedly connected to the heel counter.

16. The athletic shoe of claim 14 wherein the sole has a medial margin and opposed lateral margin and the first, second, third and fourth sole locations are located along the medial margin of the sole, the shoe further comprising third and fourth cable-panels, each having a substantially inelastic cable connected to a flexible panel, the cables being anchored to the lateral margin.

17. The athletic shoe of claim 16 wherein each cable-panel has a margin that is distal the sole, which margins combine to define a lacing margin, wherein each cable-panel defines at least one eyelet located along the lacing margin.

18. The athletic shoe of claim 14 wherein each flexible panel is fixedly attached to the sole.

19. The shoe of claim 14 wherein the shoe has a lateral margin and opposed medial margin, the first and second cable-panels and first, second, third and fourth sole locations being disposed on the lateral side, the shoe further comprising third and fourth cable-panels disposed on the medial side and anchored by respective cables secured to the sole at medial sole locations in a mirror image fashion to the lateral side.

20. An athletic shoe, comprising:

a sole having a toe portion, a ball portion, an arch portion and a heel portion;

a heel counter fixedly connected to the sole at the heel portion;

a first cable-panel having a substantially inelastic cable connected to a flexible sheet wherein a first end of the cable is fixedly connected to the sole at the toe portion and a second end of the cable is fixedly connected to the sole at the arch portion; and a second cable-panel having a substantially inelastic cable connected to a flexible sheet wherein a first end of the cable is fixedly connected to the sole at the ball portion and a second end of the cable is fixedly connected to the sole at the heel portion so that the first cable-panel and the second cable-panel partially overlap between the ball portion and the arch portion.

21. The athletic shoe of claim 20 further comprising a collar cable-panel having a substantially inelastic cable connected to a flexible sheet wherein the cable-panel is fixedly connected to the heel counter.

22. The athletic shoe of claim 21 wherein the sole has a medial margin and an opposed lateral margin, wherein the first and second cable-panels are located along the medial margin of the sole, and further comprising third and fourth cable-panels located along the lateral margin of the sole.

23. The athletic shoe of claim 22 wherein each cable-panel has a margin distal to the sole, the margins collectively defining a pair of opposed lacing margins and wherein each cable-panel defines at least one eyelet located along one of the lacing margins.

24. The athletic shoe of claim 23 wherein the collar cable-panel has a forward margin located distal to the heel counter, which forward margin forms a part of the lacing margin.

25. The athletic shoe of claim 20 wherein the second end of the second cable associated with the second cable-panel is fixedly connected to the heel counter.

26. The athletic shoe of claim 20 wherein the sole further comprises a molded midsole and all the cable ends are embedded in the molded midsole.

27. A shoe comprising:

a footbed having lateral and medial footbed portions and toe and heel portions;

an upper having lateral and medial upper portions;

the lateral and medial upper portions each having a plurality of discrete cable-panels, each of which is reinforced by a respective substantially inelastic cable secured thereto, wherein at least two of the cables in the lateral upper portion and two of the cables in the medial upper portion have opposite ends anchored in the footbed; and wherein at least two of the cable panels partially overlap one another along a portion of the side between the toe and heel portions.

28. The shoe of claim 27 further including a heel cable panel and a heel cable secured thereto to reinforce the heel cable panel.

* * * * *

UNITED STATES PATENT AND TRADEMARK OFFICE

CERTIFICATE OF CORRECTION

PATENT NO. : 5,371,957

DATED : December 13, 1994

INVENTOR(S) : Paul A. Gaudio

It is certified that error appears in the above-identified patent and that said Letters Patent is hereby corrected as shown below:

Column 5, line 65, "farces" should be --forces--.

Signed and Sealed this

Eighteenth Day of July, 1995

Bruce Lehman

*Attest:*

BRUCE LEHMAN

*Attesting Officer*

*Commissioner of Patents and Trademarks*